US006657120B2

(12) United States Patent
Smith

(10) Patent No.: US 6,657,120 B2
(45) Date of Patent: Dec. 2, 2003

(54) LIGHTNING SHELTERS

(75) Inventor: Henry Roy Smith, Leominster (GB)

(73) Assignee: H. R. Smith (Technical Developments) Limited (GB)

( * ) Notice: Subject to any disclaimer, the term of this patent is extended or adjusted under 35 U.S.C. 154(b) by 0 days.

(21) Appl. No.: 10/366,015

(22) Filed: Feb. 12, 2003

(65) Prior Publication Data

US 2003/0150629 A1 Aug. 14, 2003

(30) Foreign Application Priority Data

Feb. 12, 2002 (GB) ..... 0203227

(51) Int. Cl.[7] ..... H02G 13/00
(52) U.S. Cl. ..... 174/2; 174/556; 361/117
(58) Field of Search ..... 174/2, 556, 6; 361/117; 135/96, 98, 99

(56) References Cited

U.S. PATENT DOCUMENTS 3,889,698 A * 6/1975 Roessl ..... 135/94
5,043,527 A 8/1991 Carpenter, Jr. ..... 174/2
6,167,896 B1 1/2001 Smith ..... 135/96

FOREIGN PATENT DOCUMENTS

| | | |
|---|---|---|
| GB | 345515 | 3/1931 |
| GB | 1033820 | 6/1966 |
| GB | 2332458 A | 6/1999 |
| WO | WO 94/02980 | 2/1994 |

* cited by examiner

*Primary Examiner*—Dean A. Reichard
*Assistant Examiner*—W. David Walkenhorst
(74) *Attorney, Agent, or Firm*—Townsend and Townsend and Crew LLP

(57) ABSTRACT

A shelter for individuals or groups of people caught in the open in inclement weather especially when there is a danger of lightning. The shelter includes an elongate electrically-conductive member for supporting a canopy, the elongate electrically-conductive member being configured as a lightning conductor; an electrically-conducting floor; and a coupling member for electrically connecting the elongate electrically-conductive member to the electrically-conducting floor. The coupling member includes a flange extending laterally away from the elongate electrically-conducting member, over the electrically-conductive flooring, to provide an enlarged footprint of engagement with the electrically-conducting floor.

24 Claims, 4 Drawing Sheets

LIGHTNING SHELTERS

BACKGROUND TO THE INVENTION

1. Field of the Invention

The present invention relates to shelters, particularly shelters for individuals or groups of people caught in the open in inclement weather especially when there is a danger of lightning.

2. Summary of the Prior Art

Persons caught in the open during inclement weather may be at risk of being struck by lightning. The present applicant proposed in GB 2 332 458A a lightning shelter having a cover supported by an electrically-conductive frame and a floor of electrically-conductive mesh. The frame comprised a plurality of hollow metal poles which are anchored to the ground by earthing or grounding spikes. As shown in FIG. 1, the mesh floor 10 was welded to a collar 12 surrounding the lower end of one frame pole 14 which was anchored to a grounding spike 16. The collar 12 was fixed to the metal pole by bolts 18.

SUMMARY OF THE INVENTION

The present applicant has appreciated that extremely high voltage gradients may be generated when grounding a lightning bolt through a spike in the ground. In fact, the spike dissipates to ground a current pulse associated with the lightning strike, generating a high voltage potential centred on the spike. Points on the ground spaced from the spike will be at a much lower potential, giving rise to a voltage gradient, with voltage decreasing rapidly in a radial direction from the spike. The voltage gradient may be lethal to humans and animals since an electric shock. across vital organs e.g. heart may be produced when one leg is on the ground at a much higher potential than the other (so-called step voltage).

In accordance with the present invention, there is provided a shelter comprising: an elongate electrically-conductive member for supporting a canopy, the elongate electrically-conductive member being configured as a lightning conductor; an electrically-conducting floor; and a coupling member for electrically connecting the elongate electrically-conductive member to the electrically-conducting floor, wherein the coupling member includes a flange extending laterally away from the elongate electrically-conducting member, over the electrically-conductive flooring, to provide an enlarged footprint of engagement with the electrically-conducting floor.

The footprint should be of such a size as to ensure complete electrical conduction between the elongate member and the floor. The flange may surround the elongate electrically-conductive member, and may be substantially annular. By avoiding sharp points or corners, voltage concentrations capable of starting electrical breakdown (sparks) are prevented. In this way, the flange may ensure a uniform potential (equi-potential) is produced across the electrically-conducting floor, thereby preventing the occurrence of a lethal "step voltage" during a lightning strike.

The electrically-conductive flooring may comprise a metal mesh. The coupling member may comprise a further flange which opposes and is movable relative to the aforementioned flange. The flanges may thus define a pair of jaws which are configured to engage opposite sides of the electrically-conductive flooring. The flanges may be urged together using bolts to provide a clamping action. Electrical resistance between the flange(s) and the electrically-conductive flooring may be below 100 mΩ; in this way explosive resistive heating caused by a high current lightning pulse may be avoided.

For larger shelters, the electrically-conductive flooring may comprise a first and a second metal mesh, with one overlapping the other at the coupling member. In this way, the flange may be used with an opposing part to clamp the first and second metal meshes together, urging one into intimate contact with the other.

Each metal mesh may be supplied from a roll, and may therefore have a length which is greater than its width. In the case of first and second metal meshes from a roll, one metal mesh may be aligned with its roll direction at an angle to that of the other. In other words, the meshes may be positioned so that their longitudinal axes are at an angle to each other. The angle may be 90°. In this way, a plurality of metal meshes may be used and coupled together to cover an area which could be greater than 500 $m^2$ e.g. large enough to cover a tennis court.

A portion of the elongate electrically-conductive member which extends away from the coupling member may have an electrically-insulating cover, e.g. polyurethane sheath. The cover may be configured to provide protection for an individual from a touch voltage of up to 9 kV e.g. by employing a cover of thickness of about 3 mm. The touch voltage is the voltage difference between a position 2 m from ground level up the elongate electrically-conducting member to ground potential. When lightning strikes a conductor a touch voltage of up to 9 kV may be generated, and thus an individual may need to be insulated from it.

The electrically-conducting floor may further comprise a layer of insulation on top of the metal mesh. The layer of insulation may be at least 25 mm thick to prevent spikes on sports shoes (e.g. golf shoes) from penetrating the layer of insulation and making contact with the metal mesh. The layer of insulation may comprise rubber, e.g. granulated rubber bonded with resin.

The layer of insulation may be configured to provide for rigidity, for example by comprising a hard material such as concrete.

The shelter may comprise a foundation member under the coupling member which is configured to provide ballast for the elongate electrically conductive member. For example, the foundation member might comprise a dense material such as concrete. The foundation member may help maintain the integrity of the shelter by reducing movement of the portion of the electrically conductive member which is below ground, thereby preventing the generation and enlargement of holes or voids at the bottom end of the electrically conductive member. The foundation member may surround and extend laterally away from the elongate electrically conductive member at least as far as the bolts that clamp the flanges together.

The elongate electrically-conductive member may comprise a pole and a spike member driveable into the ground, the spike member being configured to anchor one end of the pole to the ground when in use. One end of the pole may be a push fit onto an end of the spike member which remains exposed when driven into the ground. One part of the clamping member may be coupled (e.g. welded) to the spike member.

The elongate electrically-conductive member may further comprise a elongate connecting member configured at one end to be a push fit onto the lower end of the pole and at the opposite end to be a push fit onto the upper end of the spike member. The connecting member may help the pole and spike member to register with each other during assembly. In addition, the connecting member may provide a robust connection between the spike member and the pole.

The shelter may comprise at least one further electrically-conducting member configured to be driveable into and anchor in the ground around the shelter's perimeter. When anchored in the ground, the at least one further electrically-conducting member may be used to measure the electrical potential of the ground to thereby test the performance of the shelter.

DETAILED DESCRIPTION OF THE DRAWINGS

Figure 1:
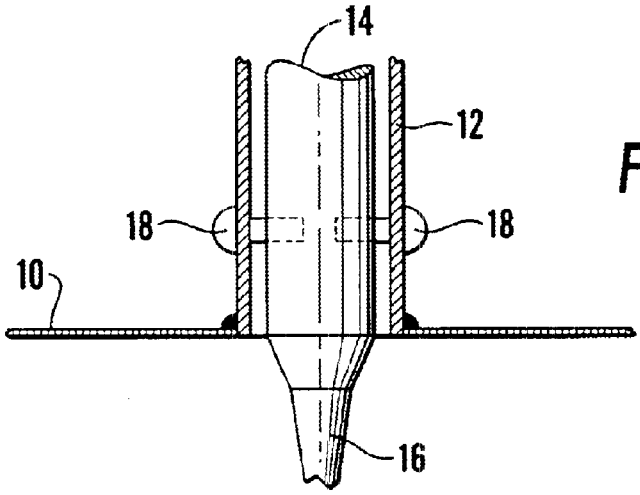
Fig. 1 (Prior Art)
FIG. 1 is a view showing detail of a prior art shelter.
Figure 2:
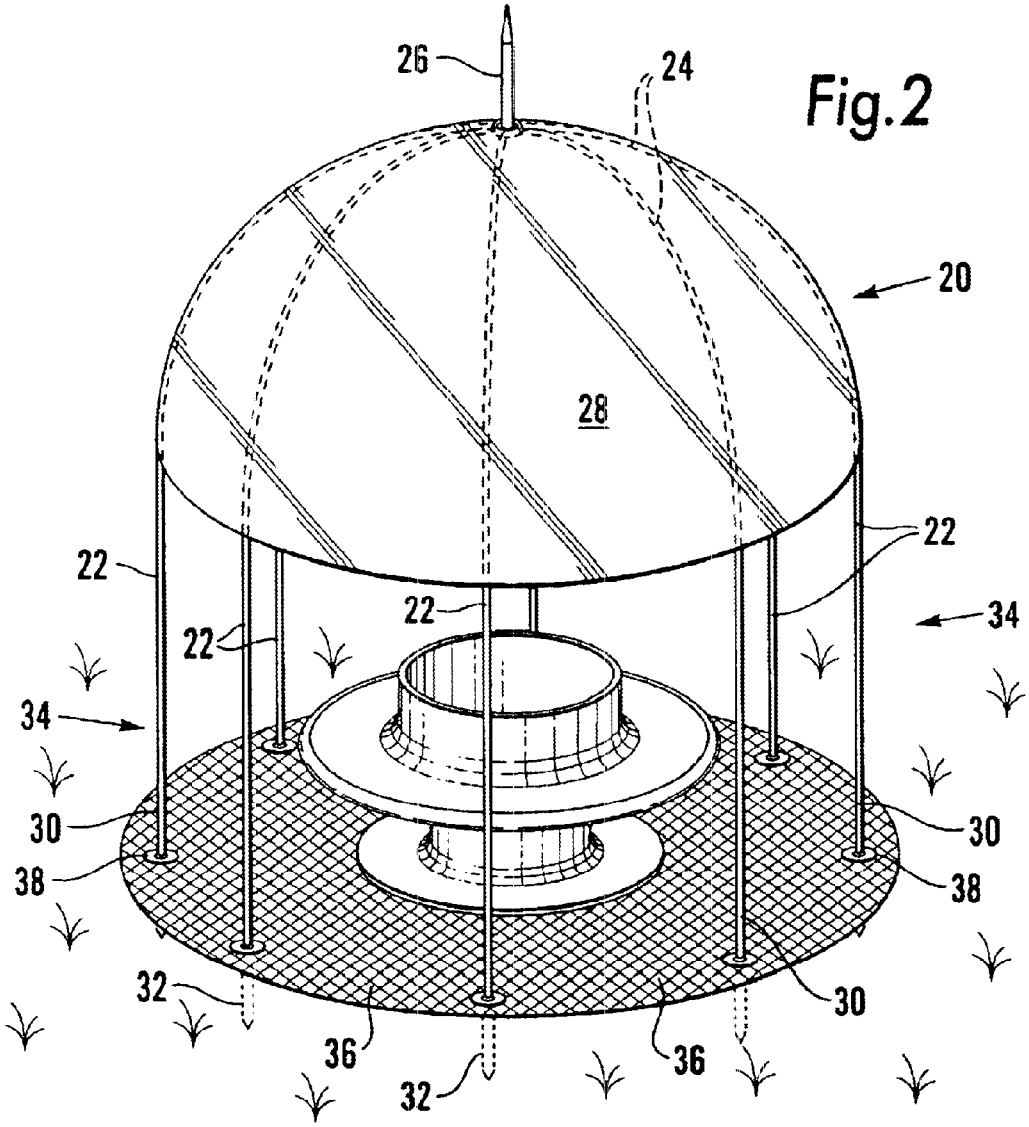
FIG. 2 is a schematic perspective view of a shelter embodying the present invention.

Specific embodiments of the present invention will now described, by way of example, and with reference to the accompanying drawings.

A shelter 20 comprises a plurality of elongate metal embers or poles 22, the upper ends 24 of which are coupled to a metal spike 26 at the apex of the canopy 28. The lower ends 30 of the poles 22 are electrically connected to metal earthing or grounding spikes 32 so that each respective pole/spike pair is configured as a lightning conductor 34. The shelter 20 is provided with a metal mesh floor 36 which is electrically connected via coupling members 38 to each lightning conductor 34. The metal mesh floor 36 extends outwardly of the lower ends 30 of poles 22 by about 0.75 m.

Figure 3:
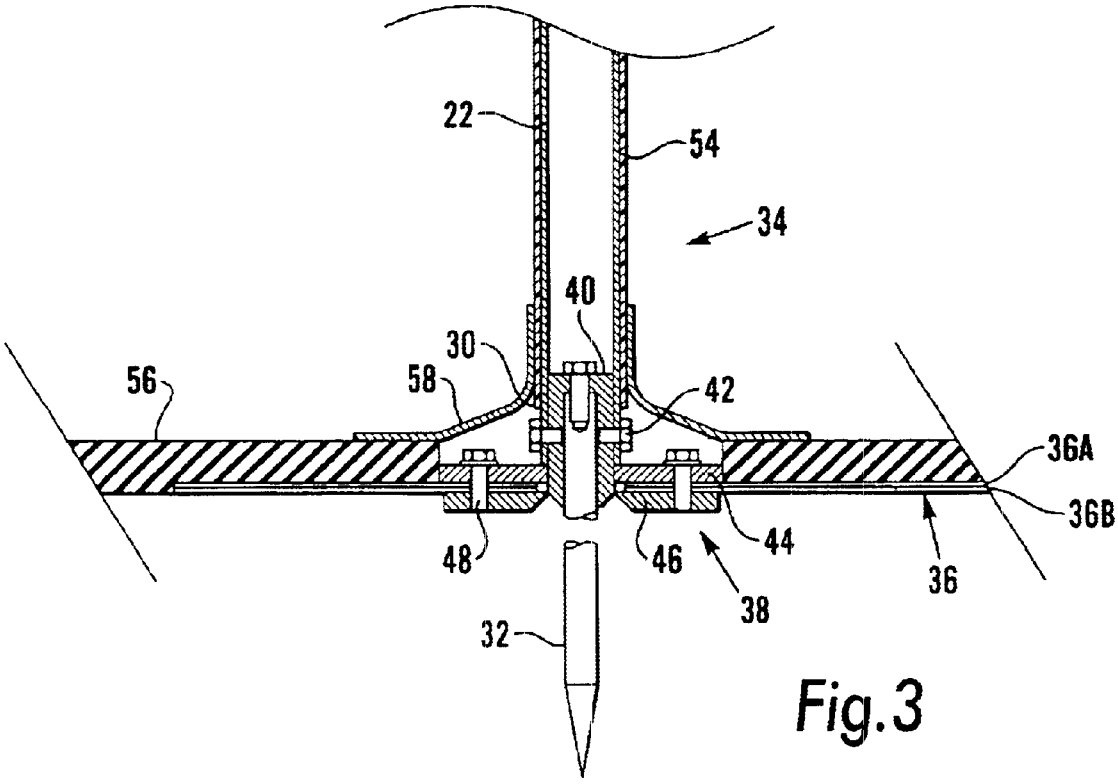
FIG. 3 is a cross-sectional view showing detail of the shelter of FIG. 2 according to a first embodiment.
Figure 4:
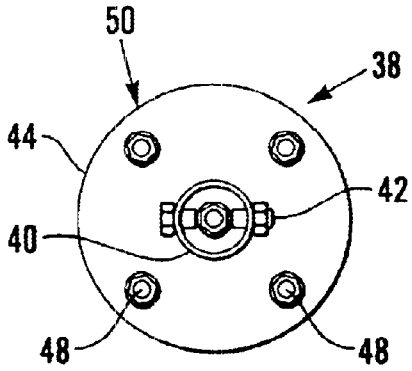
FIG. 4 is a plan view showing detail of a clamping plate of FIG. 3.

FIG. 3 shows in cross section according to a first embodiment the way in which the coupling member 38 electrically connects the metal mesh floor 36 to the lightning conductor 34 (comprising pole 22 and grounding spike 32). A metal hub 40 is bolted over the top of the grounding spike 32 and is a snug fit inside the lower end 30 of pole 22. (Bolts 42 are provided to secure the pole 22 to the hub 40). The coupling member 38 comprises an annular metal flange 44 extending laterally of and around hub 40, and over metal mesh floor 36. An annular plate 46 of an equivalent size to flange 44 is positioned beneath the metal mesh floor 36 (in registration with the annular flange 44) and is bolted at 48 to the annular flange 44. The metal mesh floor 36 is thereby clamped between the annular flange 44 and annular plate 46, ensuring intimate electrical contact between metal parts thereof. In fact, coupling member 38 provides an annular enlarged footprint 50 of engagement with the metal mesh floor 36.

The clamping action of coupling member 38 is particularly useful when the metal mesh floor 36 comprises two or more layers 36A, 36B. For example, if metal mesh is provided from a roll of such material, the two layers 36A, 36B may be orientated with the roll direction (long axis) of one perpendicular to that of the other, with the two layers overlapping at least where clamped by the coupling member 38. In this way, large areas may be covered by the shelter without jeopardising the protection afforded to anyone sheltering therein during a lightning strike.

The pole 22 is sheathed in a pipe 54 of insulating material (e.g. polyurethane pipe). A 30 mm insulating layer 56 of rubber crumb/resin may be provided on top of mesh 36. Not only does the insulating layer 56 prevent objects coming into contact with the mesh 36, even sharp objects such as shoe spikes which may stick into the insulation, but also it may raise the floor level when the mesh 36 is located beneath the ground on which the shelter stands. Furthermore, a skirt or gaiter 58 of insulating material is provided around the lower end 30 of pole 22 to shield individuals from direct contact with the coupling member 38.

Figure 5:
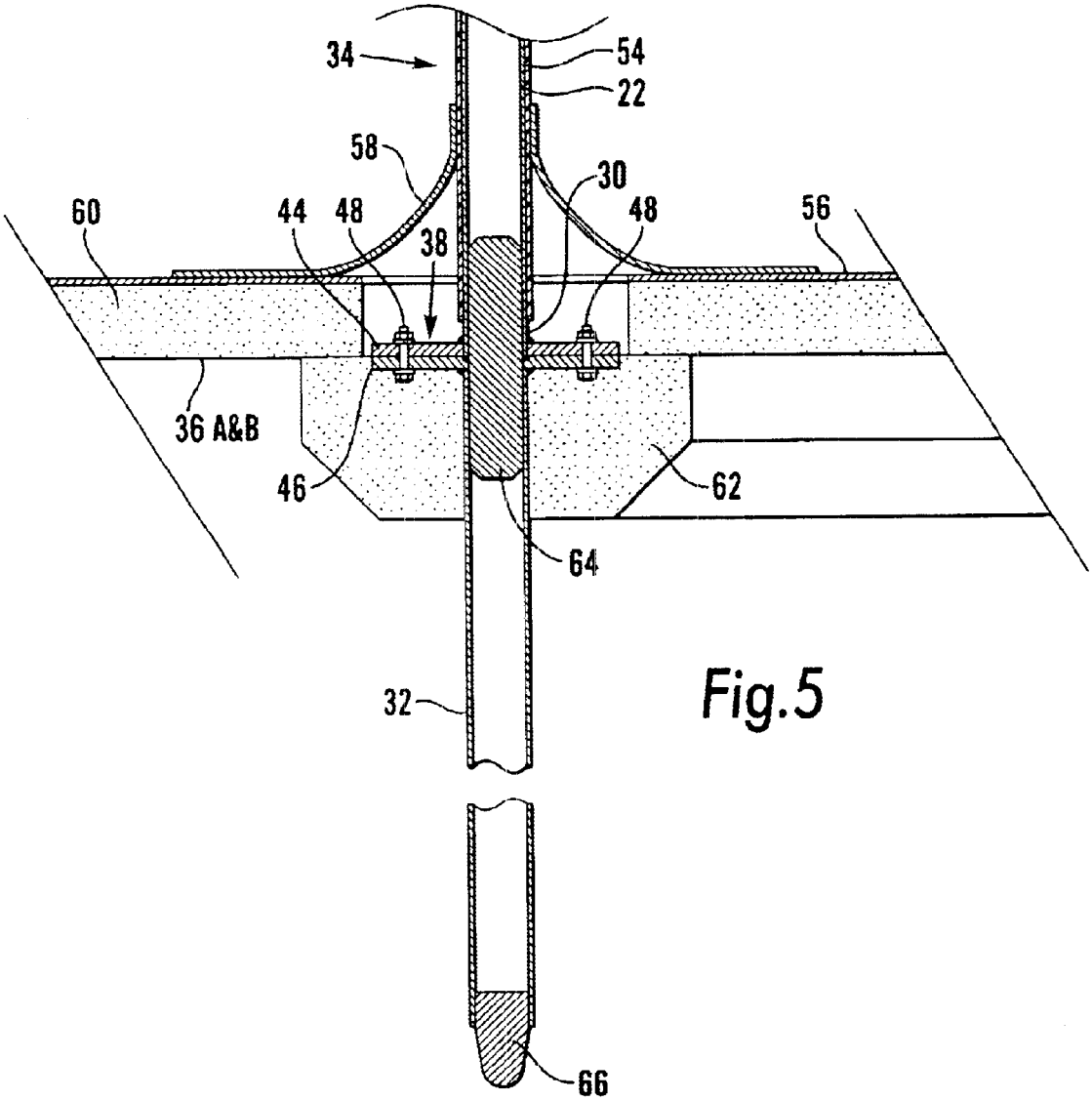
FIG. 5 is a cross-sectional view showing detail of the shelter of FIG. 2 according to a second embodiment.
Figure 6:
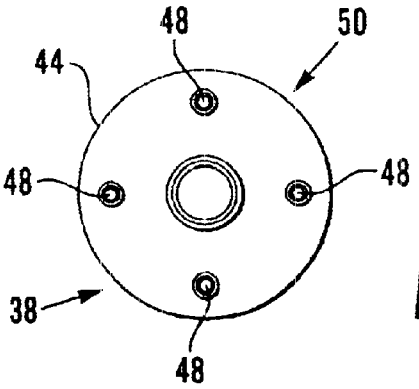
FIG. 6 is a plan view showing detail of a clamping plate of FIG. 5.

A second embodiment of the present invention is shown in FIGS. 5 and 6. Where the components of the second embodiment are the same as those of the first embodiment, the same reference numbers have been used. The following differences in the embodiments are to be noted:

Instead of the 30 mm insulating layer 56 of rubber crumb/resin of the first embodiment, the second embodiment has a layer of concrete 60 over the metal mesh floor 36. The layer of concrete may improve upon the rigidity of the shelter. A thin layer, e.g. 6.5 mm (0.25 inch), of rubber crumb/resin 56 is provided over the concrete layer 60 to protect spiked footwear from being damaged by the concrete.

A foundation member 62 is provided underneath the coupling member 38. The foundation member 38 surrounds the lightning conductor 34 and extends laterally beyond the footprint 50 of engagement created by the coupling member to provide ballast for the lightning conductor. The foundation member 62 typically comprises concrete.

Instead of the hub 40 and bolt 42 arrangement of the first embodiment, the pole 22 of the second embodiment is connected to the grounding spike 32 by means of an elongate connecting member 64 of circular cross-section. As shown in FIG. 5, the opposite ends of the connecting member 64 are inserted into the lower end of the pole 22 and the upper end of the grounding spike 32 respectively. The ends of the connecting member should be a snug fit inside the pole and grounding spike to ensure secure connection of pole and grounding spike.

The grounding spike 32 of the embodiment of FIG. 5 comprises a elongate hollow cylinder, which is terminated by a solid spike 66 which is a snug push fit into the open end of the elongate hollow cylinder.

Figure 7:
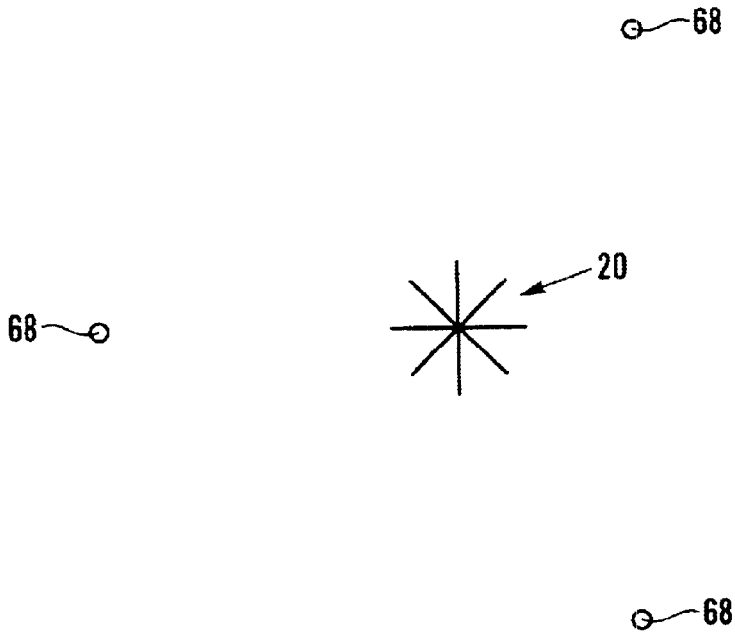
FIG. 7 is a plan view of the shelter of FIG. 2 and three test points.
Figure 8:
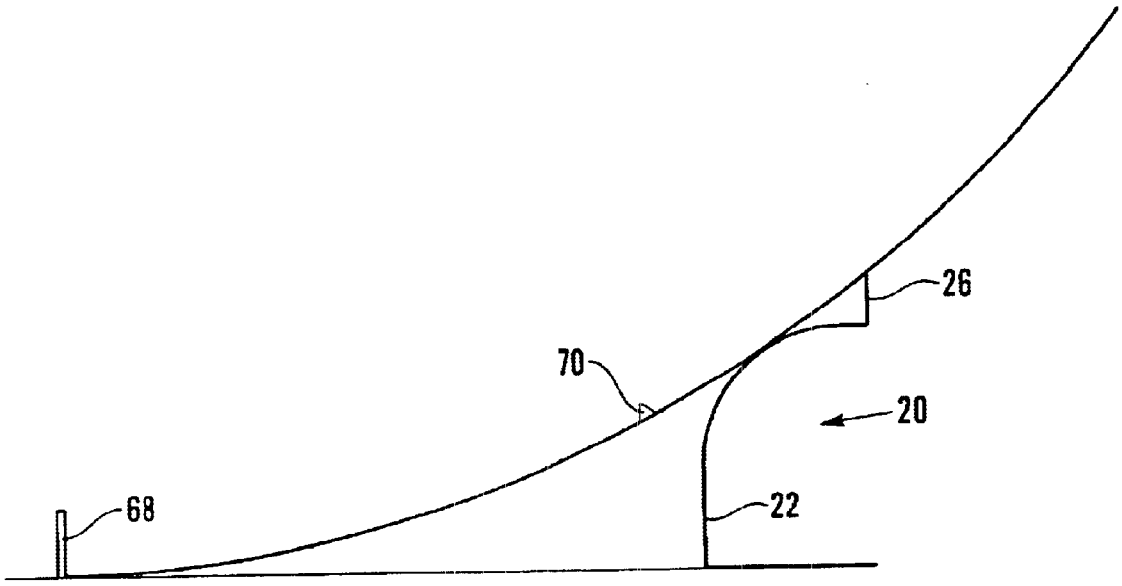
FIG. 8 is a view in profile of the arrangement of FIG. 7.

FIGS. 7 and 8 show an arrangement which allows the performance of the shelter 20 to be tested. Three earth electrodes 68 are installed in a triangular pattern in the ground around the perimeter of the shelter 20. The electrodes may be installed permanently and be provided with protective coverings. To test the shelter, test equipment is connected to the base of the metal spike 26 at the top of the shelter's canopy and to a first electrode 68 and the performance test carried out. The test equipment is disconnected from the first electrode and connected to each of the other electrodes in turn whereupon the performance test is repeated. The performance test should be in accordance with IEE 613-4 Appendix 15. The electrodes 68 should be positioned in relation to the shelter on the basis of the so-called '100 foot arc', which determines the 'safe zone' around the outside of the shelter. As shown in FIG. 8, the '100 foot arc' 70 contacts the shelter at the top of the metal spike 26 and at the poles 22. The point at which arc 70 contacts the ground determines the extent of the safe zone.

It is to be appreciated that the shelter and other features described with reference to the embodiments discussed above can be combined in other embodiments of the present invention.

What is claimed is:

1. A shelter comprising:

an elongate electrically-conductive member for supporting a canopy, the elongate electrically-conductive member being configured as a lightning conductor;

an electrically-conducting floor; and a coupling member for electrically connecting the elongate electrically-conductive member to the electrically-conducting floor, wherein the coupling member includes a flange extending laterally away from the elongate electrically-conducting member, over the electrically-conductive flooring, to provide an enlarged footprint of engagement with the electrically-conducting floor.

2. A shelter as claimed in claim 1, in which the flange surrounds the elongate electrically-conductive member.

3. A shelter as claimed in claim 1, in which the flange is substantially annular.

4. A shelter as claimed in claim 1, in which the electrically-conductive flooring comprises a metal mesh.

5. A shelter as claimed in claim 1, in which the coupling member comprises a further flange which opposes and is movable relative to the said flange, the flanges defining a pair of jaws which are configured to engage opposite sides of the electrically-conductive flooring.

6. A shelter as claimed in claim 5, in which the flanges are urged together using bolts to provide a clamping action.

7. A shelter as claimed in claim 6, in which the foundation member surrounds and extends laterally away from the elongate electrically conductive member at least as far as the bolts that clamp the flanges together.

8. A shelter as claimed in claim 1, in which electrical resistance between the flange(s) and the electrically-conductive conductive flooring is below 100 mΩ.

9. A shelter as claimed in claim 1, in which the electrically-conductive flooring comprises a first and a second metal mesh, with one overlapping the other at the coupling member.

10. A shelter as claimed in claim 9, in which the flange is operative with an opposing part to clamp the first and second metal meshes together, urging one into intimate contact with the other.

11. A shelter as claimed in claim 9, in which each metal mesh has a length which is greater than its width.

12. A shelter as claimed in claim 9, in which the first and second metal meshes each have a longitudinal axis, the longitudinal axis of one metal mesh being at an angle to the longitudinal axis of the other metal mesh.

13. A shelter as claimed in claim 12, in which the angle is 90°.

14. A shelter as claimed in claim 1, in which a portion of the elongate electrically-conductive member which extends away from the coupling member has an electrically-insulating cover.

15. A shelter as claimed in claim 14, in which the cover is configured to provide protection for an individual from a touch voltage of up to 9 kV.

16. A shelter as claimed in claim 1, in which the electrically-conducting floor further comprises a layer of insulation on top of the metal mesh.

17. A shelter as claimed in claim 16, in which the layer of insulation is at least 25 mm thick.

18. A shelter as claimed in claim 16, in which the layer of insulation comprises rubber.

19. A shelter as claimed in claim 16, in which the layer of insulation is configured to provide for rigidity.

20. A shelter as claimed in claim 1, comprising a foundation member under the coupling member which is configured to provide ballast for the elongate electrically conductive member.

21. A shelter as claimed in claim 1, in which the elongate electrically-conductive member comprises a pole and a spike member driveable into the ground, the spike member being configured to anchor one end of the pole to the ground when in use.

22. A shelter as claimed in claim 21, in which one end of the pole is a push fit onto an end of the spike member which remains exposed when driven into the ground.

23. A shelter as claimed in claim 21, in which the elongate electrically-conductive member further comprises a elongate connecting member configured at one end to be a push fit onto the lower end of the pole and at the opposite end to be a push fit onto the upper end of the spike member.

24. A shelter as claimed in claim 1, comprising at least one further electrically-conducting member configured to be driveable into and anchor in the ground around the shelter's perimeter.

* * * * *